US005788253A

United States Patent [19]

Thomson et al.

[11] Patent Number: 5,788,253

[45] Date of Patent: Aug. 4, 1998

[54] CONVERTIBLE BABY WALKER AND GYM

[75] Inventors: Harry S. Thomson, Oakhill; Shaun Woodward, Bedford, both of England; David M. Raffo, Chester; John A. Pape, Letchworth, both of United Kingdom

[73] Assignee: Tomy UK Limited, Surry, England

[21] Appl. No.: 809,799

[22] PCT Filed: Sep. 28, 1995

[86] PCT No.: PCT/GB95/02306

§ 371 Date: Mar. 27, 1997

§ 102(e) Date: Mar. 27, 1997

[87] PCT Pub. No.: WO96/09785

PCT Pub. Date: Apr. 4, 1996

[30] Foreign Application Priority Data

Sep. 29, 1994 [GB] United Kingdom ..... 9419595

[51] Int. Cl.[6] ..... A47D 13/04; A61H 33/00

[52] U.S. Cl. ..... 280/87.041; 280/87.041; 280/87.051; 280/47.38; 446/71

[58] Field of Search ..... 280/87.041, 87.051, 280/47.38; 446/71, 227, 451, 465; 472/15; 482/69

[56] References Cited

U.S. PATENT DOCUMENTS 5,454,745 10/1995 Spielberger ..... 446/71

FOREIGN PATENT DOCUMENTS 1332044 10/1973 United Kingdom .
2211428 7/1989 United Kingdom .
2211429 7/1989 United Kingdom .
2293555 4/1996 United Kingdom .

*Primary Examiner*—Gary C. Hoge
*Assistant Examiner*—Clovia Hamilton
*Attorney, Agent, or Firm*—Dowell & Dowell, P.C.

[57] ABSTRACT

A convertible baby walker and baby gym comprising a pair of spaced-apart side frames supported on wheels. A cross-piece extends between the side frames and is extensible to adjust the spacing between the frames. The cross-piece is elevated above the side frames and serves to suspend playthings when the apparatus is in the baby gym configuration. The cross-piece is repositioned to extend adjacent a forward pair of wheels associated with the side frames to brace the side frames when the apparatus is in the baby walker configuration.

11 Claims, 3 Drawing Sheets

CONVERTIBLE BABY WALKER AND GYM

BACKGROUND OF THE INVENTION

1. Field of the Invention

This invention relates to an apparatus for use by babies and young children as either a baby walker or a baby gym.

2. History of Related Art

A baby walker is known which comprises a wheeled frame on which a child may support itself in an upright position during the early walking phase. An example of such a baby walker disclosed in British patent specification No. 2211429A comprises a support structure including a pair of spaced-apart side frames and a transversely extending cross-piece, support wheels being mounted on the side frames. The cross-piece serves to brace the side frames. A handle bar supported by stiles projecting vertically upwards from the side frames extends parallel to the cross-piece. The cross-piece is necessarily located at a low level to ensure that no play can take place between the side frames and the handle bar and render the baby walker unstable. A baby gym is also known which includes a horizontal bar from which various playthings may be suspended. To use a baby gym, a baby is laid on its back beneath the bar. GB 2211429A discloses the possibility of mounting an activity centre on the cross-piece of a baby walker for the amusement of a child capable of sitting in front of the baby walker. However, the cross-piece is located at too low a level for there to be any possibility of the activity centre being used by a baby lying on the floor.

A baby gym may be used from soon after birth but begins to lose its value when the baby starts to crawl or walk. At this stage a baby walker is found useful. Both products must be of rugged construction for safety reasons and are relatively expensive. A saving in cost to the consumer may therefore be achieved by an apparatus which combines both functions. A problem, however, is that the need to provide a cross-piece to brace the side frames at a relatively low level makes it impracticable for a baby walker to be used without modification as a baby gym. Another problem is that a baby gym is normally required to be wider than a baby walker. A further problem is that a baby gym needs to be immobilised when in use to prevent it moving away from the baby using it.

SUMMARY OF THE INVENTION

The present invention has for its object the provision of an apparatus capable of being used to support a child learning to walk and, alternatively, to suspend playthings for the amusement of a baby who has not yet started to walk and is incapable of sitting. Apparatus to be described herein in greater detail, and in accordance with the invention, comprises a support structure including a pair of spaced-apart side frames and a transversely extending cross-piece. Support wheels are mounted on the side frames to enable the apparatus to be moved across the floor when the apparatus is in use as a baby walker. When the apparatus is to be used as a baby gym, the wheels are immobilized and the cross-piece positioned in an upper position to allow a baby to lie on the floor beneath the cross-piece. Playthings may be supported on or suspended from the cross-piece to amuse the baby. Although the wheels may be removed or immobilized by brakes, it is preferred to lift the wheels from floor-engaging contact when the apparatus is in use as a baby gym. To this end, the side frames may be caused to tilt when the cross-piece is in its upper position in order to bring feet on the side frames into contact with the ground. When the apparatus is to be used as a baby walker, the cross-piece may be repositioned at a lower level to brace the side frames and increase the overall sturdiness of the apparatus. In accordance with a second aspect of the invention, the cross-piece is telescopically extensible to allow the apparatus to be made narrower when used as a baby walker and wider when used as a baby gym. When extended, the cross-piece causes the frames to tilt as mentioned above.

BRIEF DESCRIPTION OF THE DRAWINGS

Examples of apparatus in accordance with the invention will now be described by way of example with reference to the drawings in which.

DESCRIPTION OF THE PREFERRED EMBODIMENT

Figure 1:
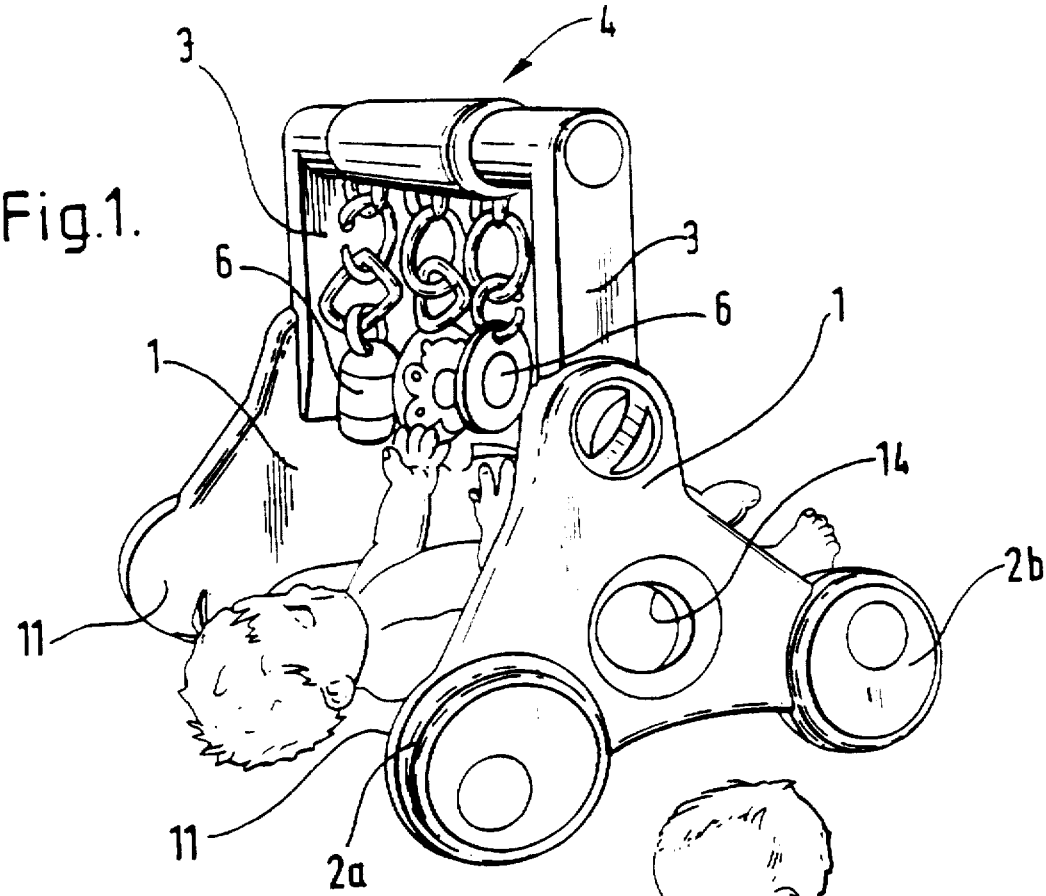
FIG. 1 is a perspective view showing the apparatus in its first configuration as a baby gym.
Figure 2:
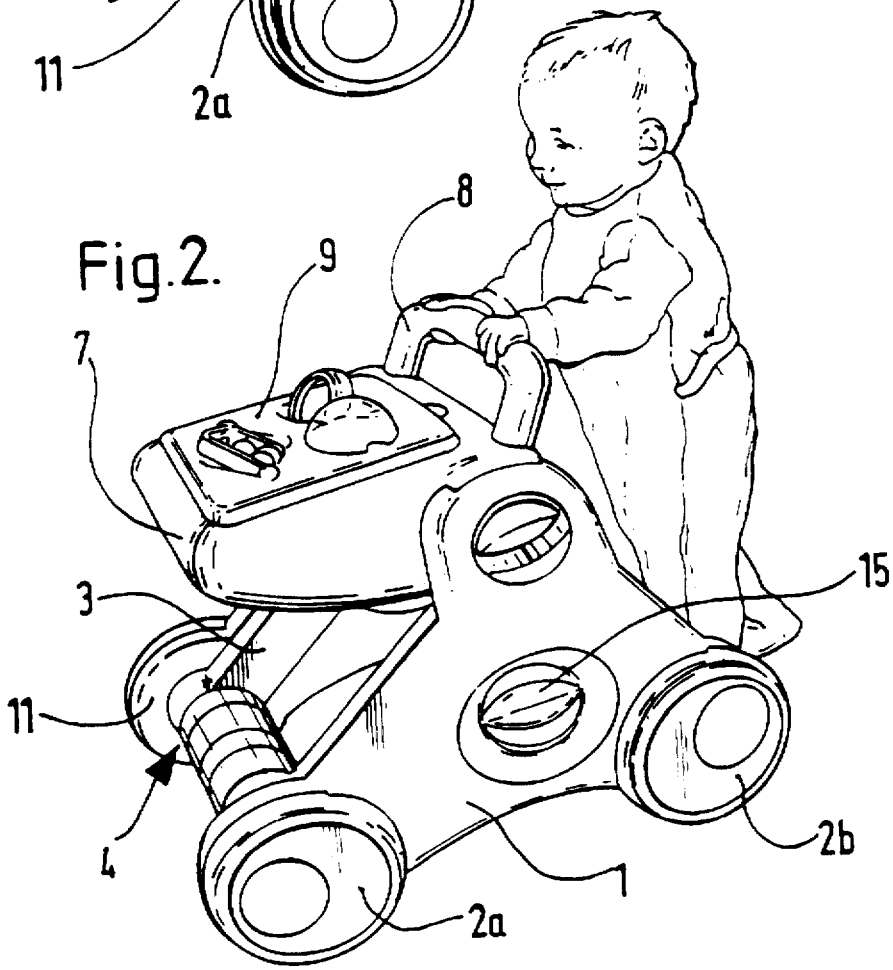
FIG. 2 is a perspective view showing the apparatus in its second configuration as a baby walker.

Referring to FIGS. 1 and 2, apparatus in accordance with the invention comprises a pair of spaced-apart side frames 1 of generally trilobular shape. Mounted for rotation on the outer side of the lower lobes 11 of each side frame are two floor engaging wheels 2*a* and 2*b*.

Pivoted to the inner side of each side-frame at a level above the wheels is a respective one of two support arms 3. A cross-piece 4 extends between the ends of the support arms remote from the pivot axis.

When the apparatus is to be used in its configuration as a baby gym, as shown in FIG. 1, the support arms 3 are arranged to extend vertically upwards as shown in FIG. 1 so that the cross-piece 4 occupies an upper position, elevated above the side frames. With the apparatus so arranged, the side frames occupy positions in which they are tilted inwards and abutment portions or feet 12 projecting from the lower lobes engage the ground and lift the wheels above it, as more clearly shown in FIG. 4. This arrangement also gives the structure greater stability. Playthings 6 intended to amuse the baby may be supported on or suspended from the cross-piece, which is provided with eyes 46, 47 for this purpose. Although the cross-piece is arranged at a level high enough to allow a baby to lie beneath the cross-bar, a baby may of course sit in front of the apparatus in this mode of use when it becomes capable of doing so.

When the apparatus is in its second configuration, i.e. as a baby walker, shown in FIG. 2, the arms 3 are arranged to extend obliquely downwards from their pivot axis so that the cross-piece occupies a lower position forwardly of a vertical centre plane through the side frames and preferably extending axially of and between the forward wheels 2*a*. A tray 7 is rigidly mounted between the frames when the apparatus is in this configuration and has a handle bar 8 on which a young child may support itself when using the apparatus as a baby walker. The tray has a recess which may be used to receive a plate 9 on which an activity centre or playthings are mounted.

The cross-piece 4 is of telescopic construction so that it may be shortened to reduce the inter-frame spacing when the apparatus is to be used as a baby-walker, or lengthened when it is to be used as a baby gym.

Figure 3:
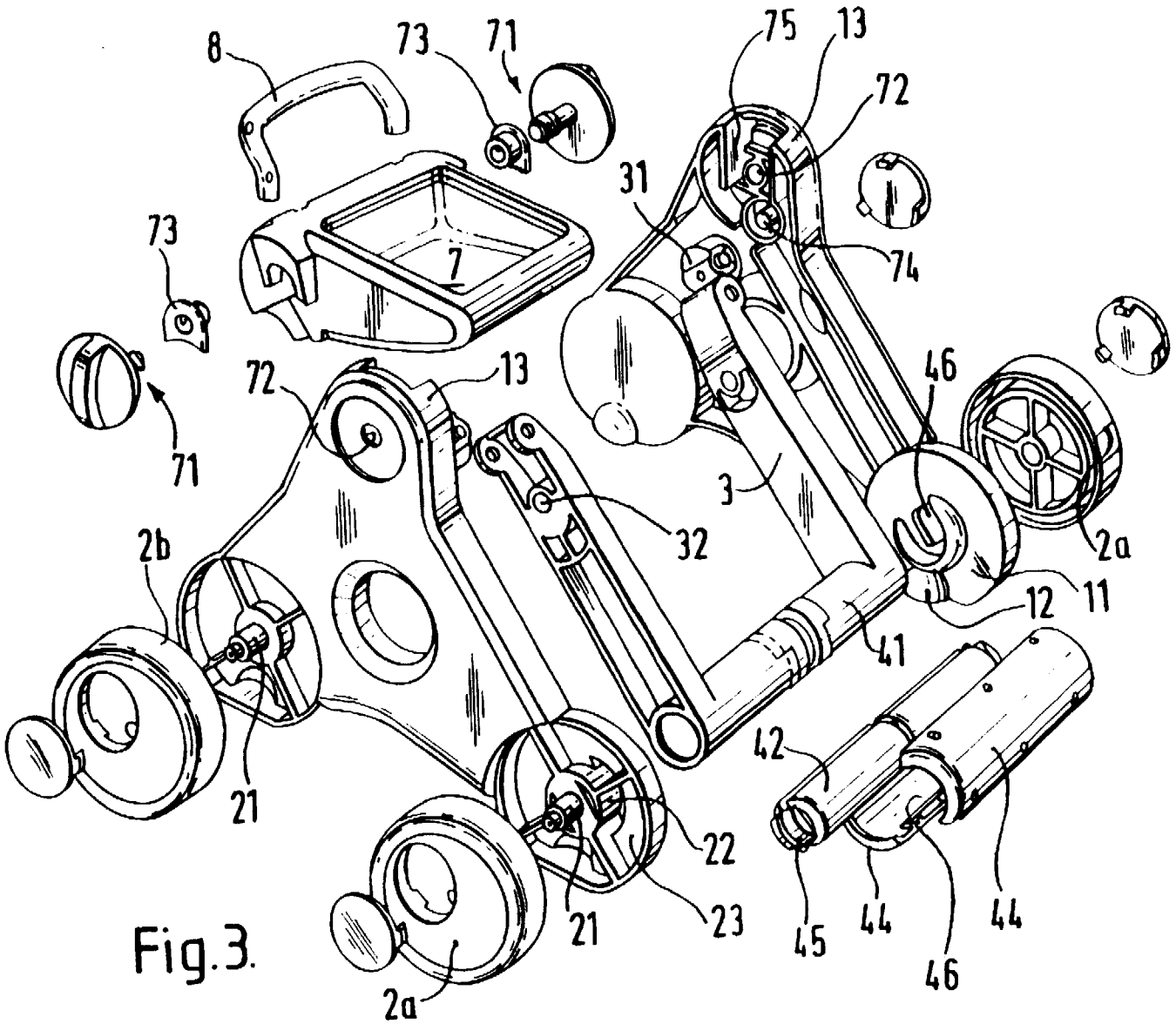
FIG. 3 is an exploded view of the apparatus.

The construction of the apparatus will now be described in more detail. Referring to FIG. 3, it will be seen that each of the wheels 2a and 2b is journalled on a spigot 21 protruding from a boss 22 within a recess 23 in the outer side of the respective lower lobe of the frame.

Each upper lobe 13 is formed with an internal, vertically extending slot 75 opening to its upper side. A screw 71 having an enlarged head passes through a bore 72 opening into the slot 75. In the baby walker configuration, the screws 71 are screwed into threaded inserts 73 which interlock with and retain the tray 7 between the side frames. The handle 8 is secured by screws, not shown, to the rear side of the tray or, alternatively, may be moulded in one piece with the tray. Arranged on each side frame below the bore 72 is a pivot pin 74 for a pivot 31 for one end of a respective one of the arms 3. The pivot 31 serves as a universal joint to allow the arm 3 to rotate about the axis of the pin 74 and to adjust in a plane perpendicular to that of the side frame. The other end of each arm 3 is integral with one of two aligned tubes 41 which receive a core 42. An outer drum 43 formed from two inter-connected semi-cylindrical shells 44 surrounds the aligned tubes 41.

Each end of the core 42 is formed with a male fitting 45 having a rectangular head and narrower neck and capable of being passed through a rectangular opening 46 into the boss from which spigot 21 projects. The fittings 45 and openings 46 are so shaped as to enable the core to interlock with the frames upon being rotated through 90°, and to be releasable therefrom when twisted back into its initial position.

During conversion of the apparatus from the baby gym configuration to its baby walker configuration, the frames are pushed towards each other, causing the tubes to telescope within the drum 43 until the ends of the tubes 41 abut, as shown in FIG. 3. The male fittings 45 are inserted into the openings at the end of this action and twisted to interlock the cross-piece with the side frames. Locking ribs 46 within the drum 43 are engagable with the tubes 41 when the apparatus is in the baby walker configuration to maintain the end of the tubes juxtaposed to each other. The cross-piece is thereby aligned with the leading wheels 2a and provides the child with adequate leg room between the side frames.

Figure 4:
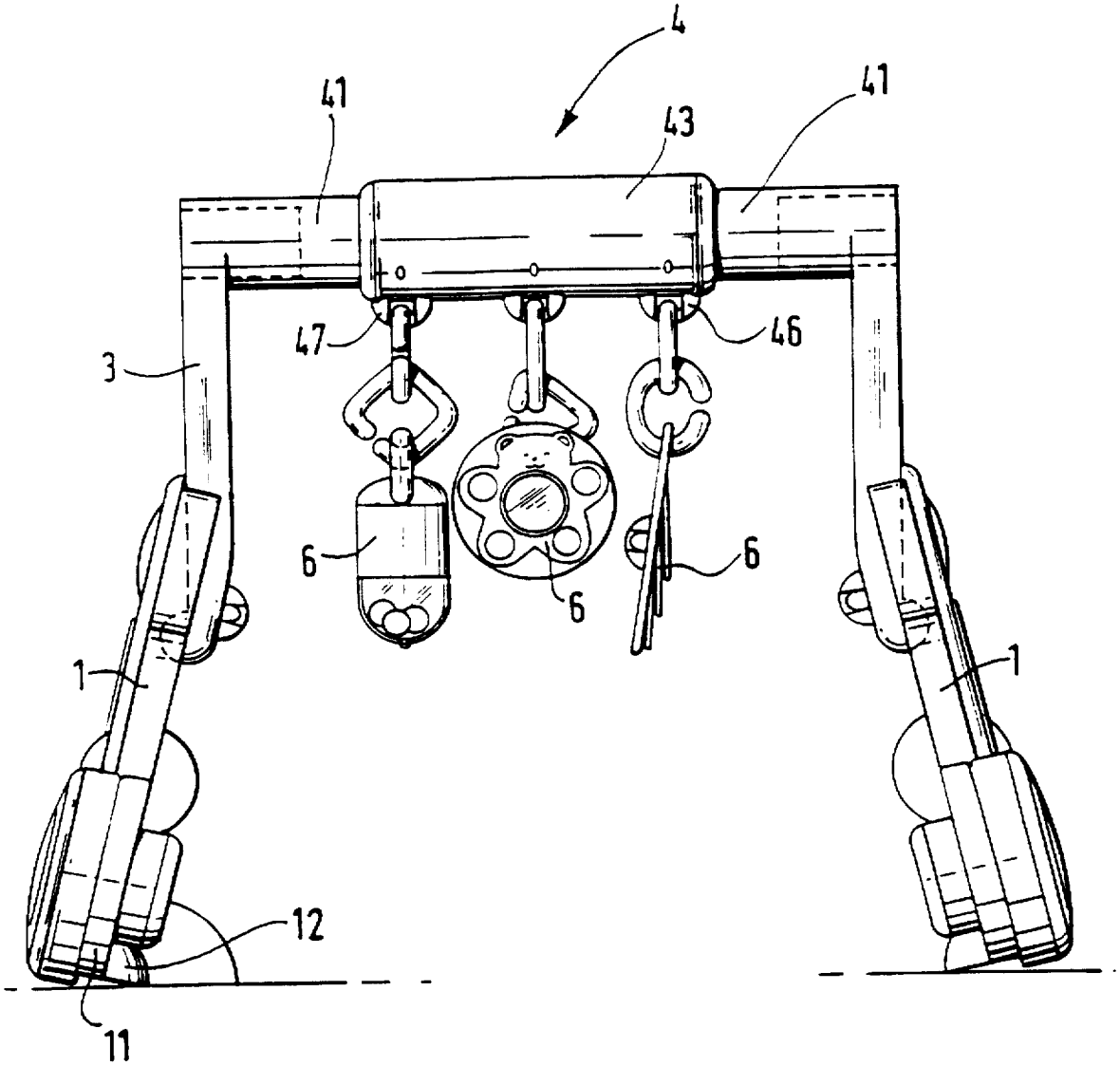
FIG. 4 is an end view of the apparatus when in its first configuration.

To convert the apparatus into its baby gym configuration, the screws 71 are withdrawn to release the tray 7, which is removed. The arms 3 are rotated into vertically upwardly extending positions, so as to engage within the slots 75 in the side frames. The screws 71 are then reinserted into the bores 72 and screwed into bores 32 in the arms 3 to secure the arms in their generally upright positions. The slots 75 define abutment surraces which are so configured that the arms are held at an inclination to the planes of the side frames, as shown in FIG. 4. The effect is to position the side frames at a desired inclination to the vertical, whereby the frames are supported on feet 12 with the wheels lifted clear of the floor. Moreover, because the frames are inclined towards each other, the stability of the apparatus is increased.

During conversion into the baby gym configuration, drum 43 is rotated into a position to cause eyes 46, 47 on the drum to face downwards. Hooks for suspending playthings 6 for the amusement of the baby may be removably fitted to the eyes.

By removing the plate 9 from the tray 7, the baby walker may be used as a pushchair or trolley by an older child. The tray, separated from the apparatus, may be used as an activity table, and the playthings on the support plate may be used separately from the tray.

To provide the overall apparatus with a more attractive appearance, openings 14 in the side frames may receive further amusement devices 15, and hub caps may be snap fitted into openings in the wheels. As illustrated, the hub caps are eccentric to the wheels. Substantially all of the parts of the apparatus may be moulded from plastics. Metal may be used for certain screws or where otherwise desirable.

Modifications may be made to the apparatus. For example, it is not essential for the cross-piece to align with the axis of the wheels when the apparatus is in the baby walker configuration. The cross-bar must, of course, be located where it will not obstruct the child's legs and will serve to brace the side frames and prevent play between the various parts of the apparatus which could lead to instability when in use. Separate means may be provided for braking the wheels or engaging the floor in the baby gym configuration instead of tilting the side frames to cause integral feet to engage the floor. The handle bar 4 may be secured direct to the side frames, with or without the use of a separate tray 7.

Instead of the cross-piece being movable pivotally from one position to another, it may be removed entirely and refixed. The cross-piece may be lengthened using a separate extension piece, or pieces, when converting into the baby gym configuration, instead of using a telescopic cross-piece.

In an alternative form or apparatus, the side frames may be interconnected by an adjustable telescopic cross-piece which serves as a handle in the babywalker configuration and for supporting playthings in the baby gym configuration. Such a cross-piece may be slidably adjustable in height. A second cross-piece may be adjustably or detachably secured between the side frames to brace the same in the baby walker configuration. Although it is preferred for all of the wheels to be mounted on the side frames, it falls within the scope of the invention for each side frame to be provided with but a single wheel, and for one or more forward wheels to be carried by the cross-piece.

We claim:

1. An apparatus for use by babies and young children alternately as a baby gym and baby walker, the apparatus comprising:

a support structure including a pair of spaced-apart side frames having wheels mounted thereon, a transversely extending cross-piece mounted on arms movable about a pivot axis to position said cross-piece alternately in an upper and a lower position, means for securing said cross-piece in each of said upper and lower positions relative to said side frames, said arms extending generally upwards when said cross-piece is in said upper position whereby said cross-piece is supported above said side frames, said arms extending obliquely downwards when said cross-piece is in said lower position, whereby said cross-piece is positioned forwardly of a vertical center plane taken between and generally perpendicular to said side frames, and said cross-piece bracing said side frames in said lower position.

2. The apparatus as claimed in claim 1, further comprising means to prevent the apparatus from moving on said wheels when said cross-piece is in said upper position.

3. The apparatus as claimed in claim 2, wherein said means to prevent the apparatus from moving includes abutment portions extending from said side frames for engagement with a surface on which the apparatus is supported to prevent the apparatus from moving on said wheels when said cross-piece is in said upper position.

4. The apparatus as claimed in claim 3, wherein said cross-piece causes said side frames to tilt to engage said abutment portions with a surface on which the apparatus is supported when said cross-piece is in said upper position.

5. The apparatus as claimed in claim 1, wherein said cross-piece extends generally co-axially with a forward pair of said wheels when said cross-piece is in said lower position.

6. An apparatus for use by babies and young children alternately as a baby gym and as a baby walker, the apparatus comprising:

a support structure including a pair of spaced-apart side frames, a transversely extending cross-piece, means supporting said cross-piece relative to said side frames, said means for supporting being movable to position said cross-piece in alternate upper and lower positions, wheels mounted on the side frames, the apparatus being usable as a baby gym when said cross-piece is in said upper position and as a baby walker when said cross-piece is in said lower position, said side frames including abutment portions, means for causing said side frames to incline when said cross-piece is in said upper position to thereby cause said abutment portions to engage a surface and said wheels to disengage the surface.

7. An apparatus for use by babies and young children alternately as a baby gym and as a baby walker, the apparatus comprising:

a support structure including a pair of spaced-apart side frames and a transversely extending cross-piece, wheels mounted on said side frames, said cross-piece being adjustable between an upper position in which said cross-piece may be used to support playthings to thereby allow the apparatus to be used as a baby gym, and an alternate lower position in which said cross-piece braces said side frames, said cross-piece extending generally co-axially with a forward pair of said wheels when in said lower position to allow the apparatus to be used as a baby walker.

8. The apparatus as claimed in claim 7, wherein said side frames have abutment surfaces engaged by said arms when said cross-piece is in said upper position, each abutment surface being inclined relative to a plane of an associated side frame, said arms extending vertically upwards so that the engagement of said abutment surfaces by said arms causes said side frames to incline toward one another.

9. The apparatus as claimed in claim 8 including a detachable tray and handle adapted to be mounted between said side frames when said cross-piece is in said lower position.

10. An apparatus for use by babies and young children alternately as a baby gym and baby walker comprising:

a support structure including a pair of spaced-apart side frames and a transversely extending cross-piece, wheels mounted on said side frames, the apparatus being usable as a baby gym in a first configuration and as a baby walker in the second configuration, said cross-piece being of telescopic construction and extensible so as to vary the spacing between said side frames, said cross-piece being adapted to support playthings in said first configuration and to brace said side frames in said second configuration, said arms extending generally upwards when said cross-piece is in an upper position to support said cross-piece above said side frames, and said arms extending obliquely downwards when said cross-piece is in a lower position wherein said cross-piece is positioned forwardly of a vertical center plane taken between and generally perpendicular to said side frames and braces said side frames.

11. An apparatus for use by babies and young children alternately as a baby gym and baby walker comprising:

a support structure including a pair of spaced-apart side frames and a transversely extending cross-piece, said side frames being provided with wheels and ground engaging abutment portions, said cross-piece being supported on arms pivoted to said side frames, said arms having a generally vertically upwardly extending position wherein said cross-piece is elevated above said side frames, said cross-piece being adapted to serve in said upwardly extending position as a support for playthings for a baby lying beneath said cross-piece, said side frames and said arms having cooperating surfaces, said surfaces being so angled to cause said side frames to tilt towards each other when said cross-piece is in said upwardly extending position to cause said abutment portions to contact a support surface and thereby prevent the apparatus from moving on said wheels.

* * * * *